US012138506B2

(12) United States Patent
Perhavec et al.

(10) Patent No.: US 12,138,506 B2
(45) Date of Patent: Nov. 12, 2024

(54) FITNESS EQUIPMENT

(71) Applicant: Blindside Group Pty Ltd, Molendinar (AU)

(72) Inventors: Anej Perhavec, Molendinar (AU); Christian Purnell, Pacific Pines (AU); James Albert Montesalvo, Molendinar (AU)

(73) Assignee: Blindside Group Pty Ltd, Molendinar (AU)

( * ) Notice: Subject to any disclaimer, the term of this patent is extended or adjusted under 35 U.S.C. 154(b) by 154 days.

(21) Appl. No.: 17/490,391

(22) Filed: Sep. 30, 2021

(65) Prior Publication Data

US 2022/0126163 A1 Apr. 28, 2022

(30) Foreign Application Priority Data

Oct. 23, 2020 (AU) ..... 2020903844
Feb. 24, 2021 (AU) ..... 2021900496

(51) Int. Cl.
*A63B 21/00* (2006.01)

(52) U.S. Cl.
CPC ..... *A63B 21/4035* (2015.10); *A63B 2225/09* (2013.01)

(58) Field of Classification Search
CPC ..... A63B 1/005; A63B 17/04; A63B 21/078; A63B 21/0783; A63B 21/08; A63B 21/4035; A63B 21/4047; A63B 21/4049; A63B 26/00; A63B 71/0054; A63B 2225/09; A63B 2225/093; A63B 2244/09; F16B 7/042; F16B 7/105; F16B 21/12
See application file for complete search history.

(56) References Cited

U.S. PATENT DOCUMENTS 2,504,922 A * 4/1950 Dowell ..... A63B 25/00 482/76
6,347,777 B1 * 2/2002 Webber ..... F16B 7/105 248/188.5
6,551,226 B1 * 4/2003 Webber ..... F16B 7/105 482/148
8,337,370 B2 * 12/2012 Rogers ..... A63B 71/0036 482/94
9,597,539 B2 * 3/2017 Grider ..... A63B 21/00047
9,907,991 B2 * 3/2018 Leipheimer ..... A63B 21/0626
11,278,757 B2 * 3/2022 Schmidt ..... A63B 23/0405
11,369,833 B2 * 6/2022 Leipheimer ..... A63B 21/4043
11,517,785 B1 * 12/2022 Nolan ..... A63B 17/04
(Continued)

FOREIGN PATENT DOCUMENTS

CA 2975287 C * 8/2023 ..... B21D 28/34

*Primary Examiner* — Gary D Urbiel Goldner
(74) *Attorney, Agent, or Firm* — Dorsey & Whitney LLP

(57) ABSTRACT

The present invention relates to fitness equipment. The fitness equipment includes an attachment and a support including discrete formations. A latching pin is provided for latching with the discrete formations to fasten the attachment to the support at different locations. Advantageously, the latching pin may lock the attachment in position without user interaction with the latching pin itself. The latching pin may be actuated by the user installing the attachment. The attachment may be installed less cumbersomely than the non-latching pin arrangement.

20 Claims, 16 Drawing Sheets

(56) References Cited

U.S. PATENT DOCUMENTS

| | | | | |
|---|---|---|---|---|
| 2007/0155594 | A1* | 7/2007 | Rogers | A63B 71/0036 482/94 |
| 2007/0240281 | A1* | 10/2007 | Meissner | A63B 69/0048 16/108 |
| 2011/0319230 | A1* | 12/2011 | Brendle | A63B 21/4013 482/37 |
| 2014/0200117 | A1* | 7/2014 | Grider | A63B 17/04 482/104 |
| 2017/0007877 | A1* | 1/2017 | Leipheimer | A63B 21/4029 |
| 2018/0353795 | A1* | 12/2018 | Ostmeyer | A63B 1/00 |
| 2020/0222745 | A1* | 7/2020 | Leipheimer | A63B 23/03525 |

* cited by examiner

FITNESS EQUIPMENT

TECHNICAL FIELD

The present invention relates to fitness equipment.

BACKGROUND

The reference to any prior art in this specification is not, and should not be taken as an acknowledgement or any form of suggestion that the prior art forms part of the common general knowledge.

Exercise equipment adjustment and attachments are commonly affixed using pin mechanisms.

A known mechanism for adjustment and attachments of exercise equipment involves inserting a pin in one of a discrete number of holes to change the configuration of the equipment. In practice, such an adjustment mechanism is cumbersome to adjust and may require two-handed operation.

The preferred embodiment provides fitness equipment with improved affixing and adjustment.

SUMMARY

According to one aspect of the present invention, there is provided fitness equipment including:

an attachment;

a support including discrete formations; and a latching pin for latching with the formations to fasten the attachment to the support at different locations.

Advantageously, the latching pin may lock the attachment in position without user interaction with the latching pin itself. The latching pin may be actuated by the user installing the attachment. The attachment may be installed less cumbersomely than the non-latching pin arrangement.

The latching pin may include an integral anti scratch component. The integral anti scratch component may be an integral fin or a roller. The integral anti scratch component may be replaceable. The integral anti scratch component may be sacrificial.

The attachment may include a fixed pin for alignment.

The latching pin may have the alignment fixed relative to the attachment. The preferred alignment may be a rolling element. The alignment may be a keyway.

The support may be static. The support may be an upright. The support may form part of a frame of the fitness equipment. The attachment may be a spotter arm restraint or any other attachment for fitness equipment. The fitness equipment may be a rig. The fitness equipment may be a rack. The fitness equipment may be any piece of fitness equipment that can support an attachment.

According to another aspect of the present invention, there is provided fitness equipment including:

a first support;

a latching pin; and a movable second support for moving relative to the first support so that the supports can be positioned at discrete points over a range.

Any of the features described herein can be combined in any combination with any one or more of the other features described herein within the scope of the invention.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 3:
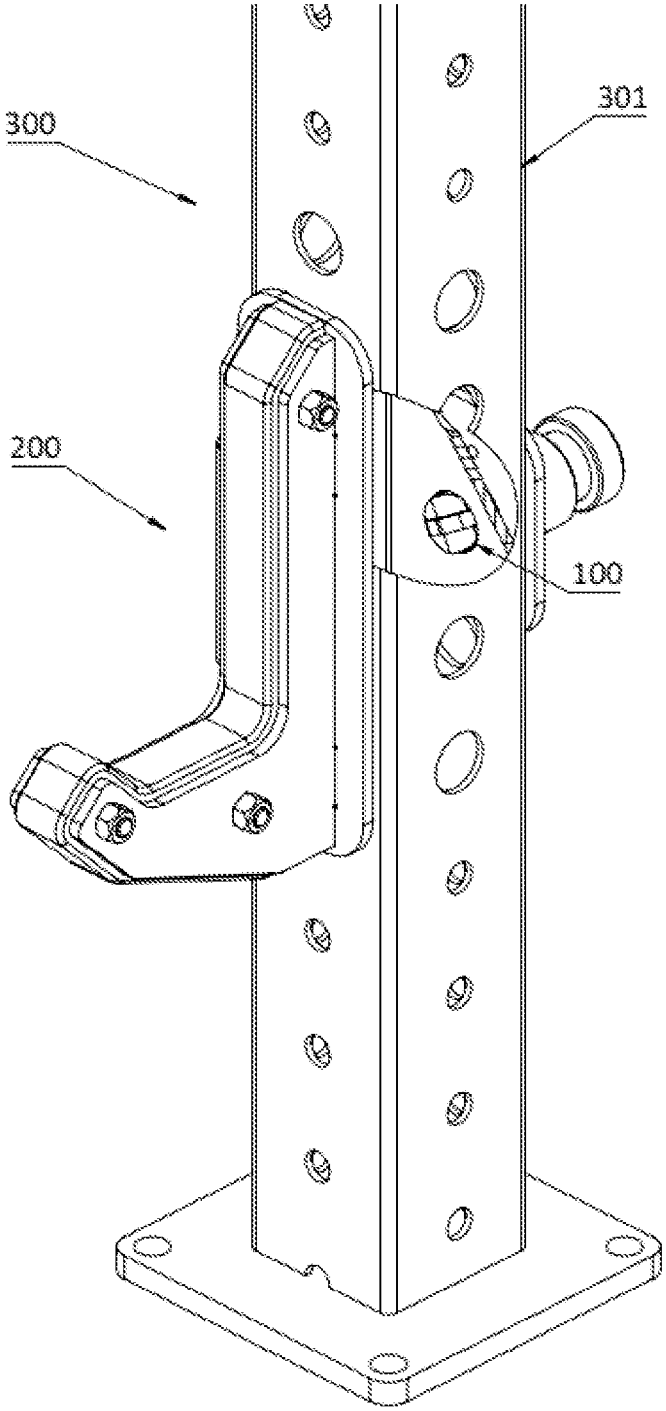
FIG. 3 is a partial perspective view of fitness equipment in accordance with an embodiment of the present invention, with the attachment in an as installed position.
Figure 4:
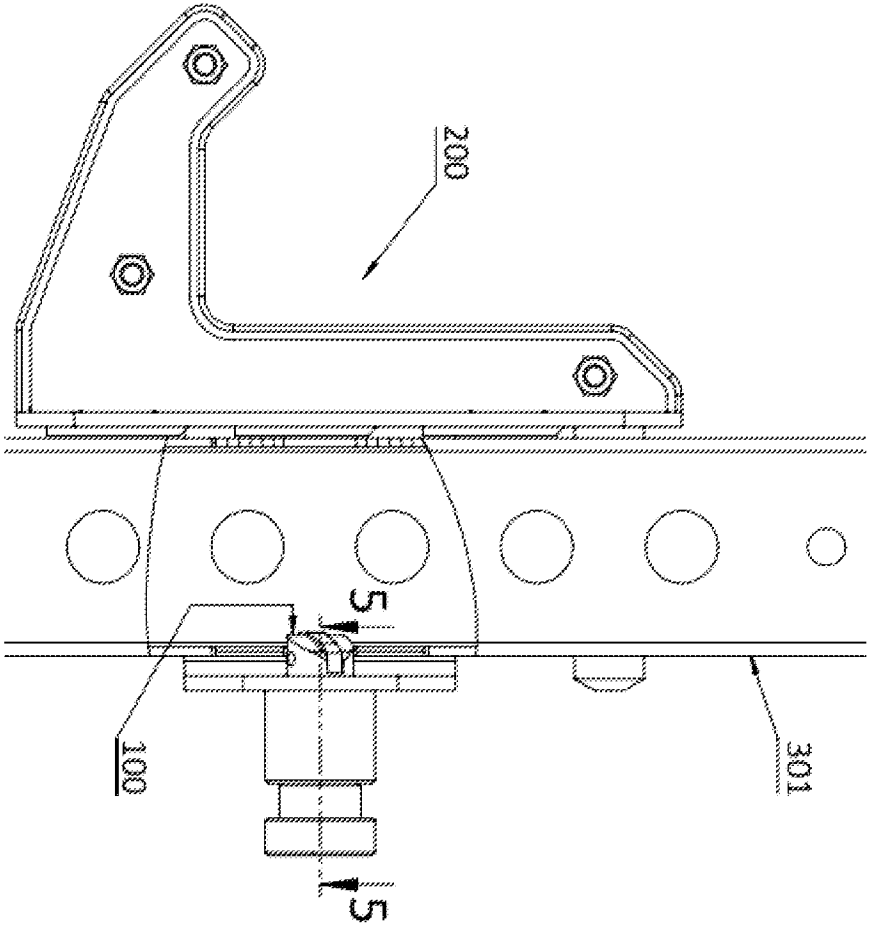
FIG. 4 is a partial side view of the fitness equipment of FIG. 3.

According to an embodiment of the present invention, there is provided fitness equipment 300, in the form of an attachment and an upright, as shown in FIG. 3. The equipment 300 includes an upright support 301 forming part of a frame of the fitness equipment 300. An attachment 200 is pivotally installed onto upright support 301. The fitness equipment 300 further includes latching pin 100 for locking the attachment onto the upright support 301. Advantageously, the latching pin 100 can lock the attachment onto the upright support 301 without direct user manipulation of latching pin 100.

Figure 7:
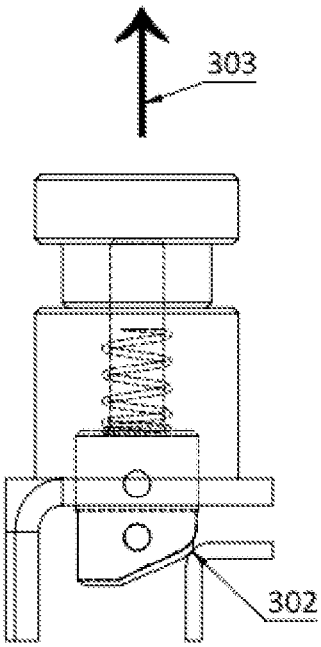
FIG. 7 is a close up partial top view of the fitness equipment of FIG. 5.

As can best be seen in FIG. 7, the latch pin 100 engages with upright support 301 at contact point 302. Latch pin 100 has a contact angle at contact point 302 such that latch pin 100 retracts in direction 303, allowing attachment 200 to be installed onto upright support 301. The foregoing installation is far less cumbersome than known pin in discrete hole arrangements.

Figure 1:
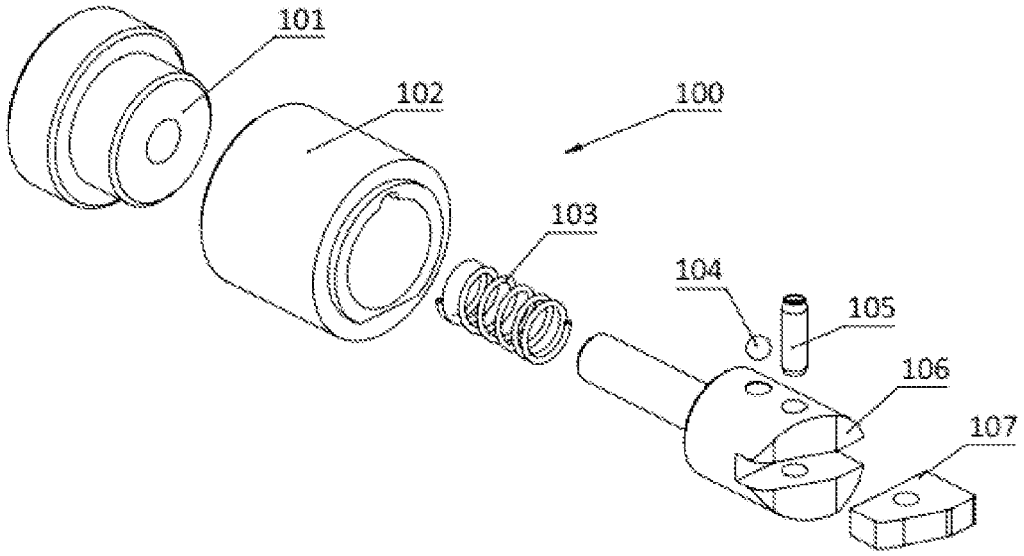
FIG. 1 is an exploded perspective view of the latching pin mechanism.

Turning to FIG. 1, according to an embodiment of the present invention, the latch pin 100 includes an integral anti scratch fin 107. Integral fin 107 is secured in latch pin body 106 by dowel pin 105. Ball bearing 104 engages with keyway in latch pin mount 102. Compression spring 103 ensures latch pin body 106 returns to the extended position. Latch pin knob 101 allows manual retraction of the latch pin to facilitate removal of attachment 200 when installed on upright support 301.

Figure 2:
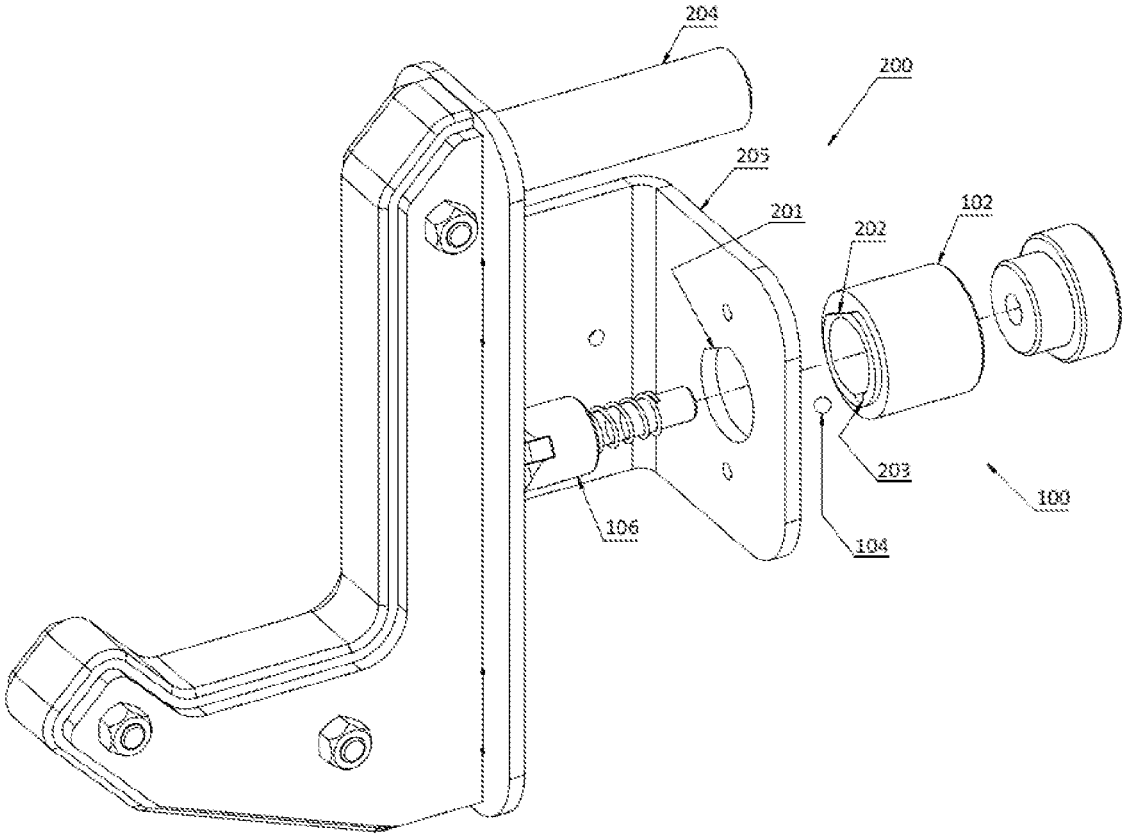
FIG. 2 is an exploded perspective view of the latching pin and attachment.

Turning to FIG. 2, alignment of latch pin mount 102 can be controlled through means of keying features 201 and 202. Alignment of Latch pin body 106 can be controlled by means of ball bearing 104 and ball keyway 203.

Figure 8:
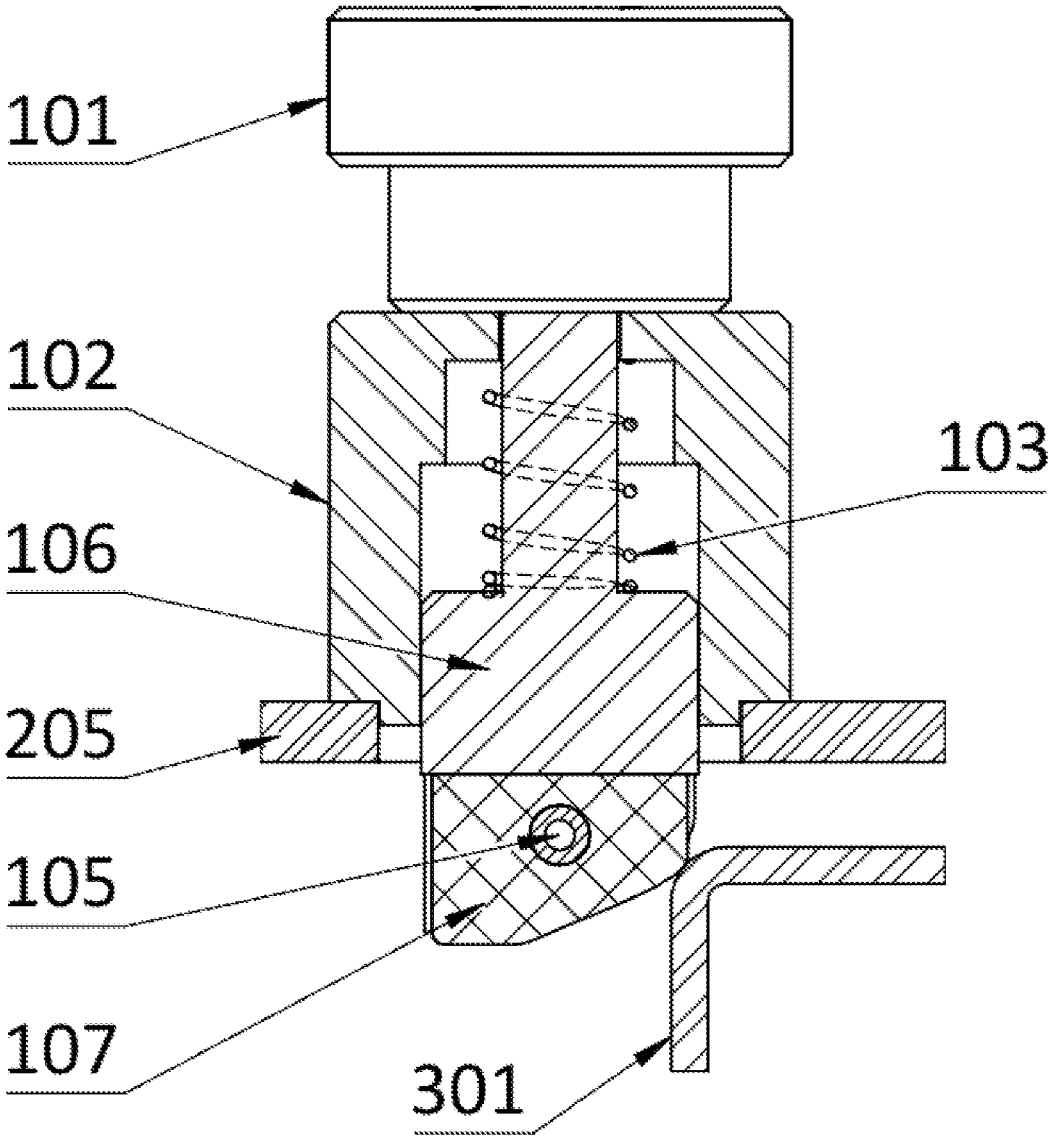
FIG. 8 is a close up partial section view of the fitness equipment of FIG. 5.

As can best be seen in FIG. 8, the integral fin 107 prevents damage to upright support 301 by coming into contact with upright support 301 on the leading edge of latch pin 100. Latch pin body 106 surrounds integral fin 107 and resists large shearing forces, which may be experienced during use of attachment 200.

As can best be seen in FIG. 8, latch pin mount 102 is affixed to attachment plate 205, such that the latch pin assembly 101, 104, 105, 106 and 107 can move relative to latch pin mount 102.

Figure 9:
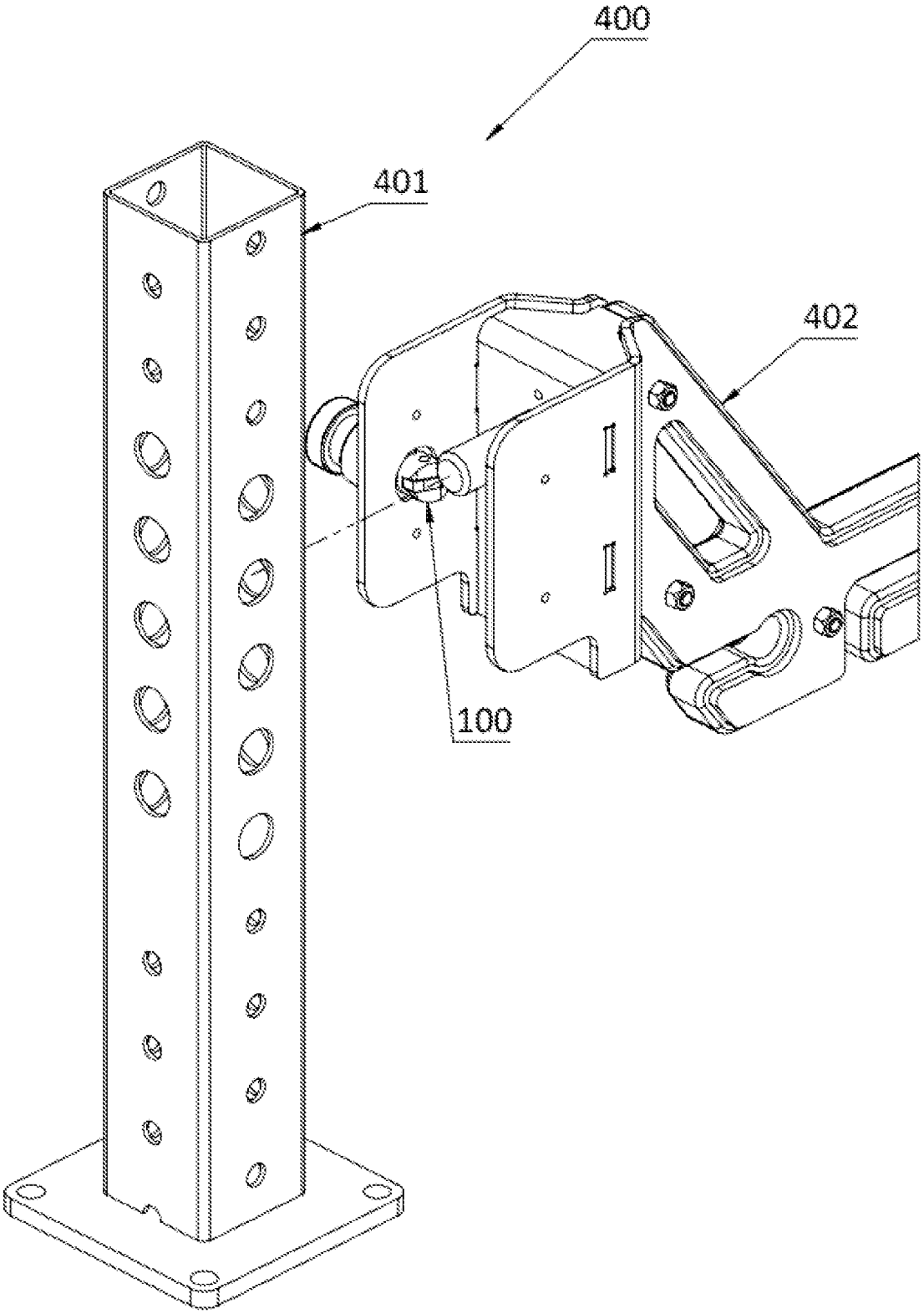
FIG. 9 is a partial perspective view of fitness equipment in accordance with an alternative embodiment of the present invention, with the attachment transitioning from an uninstalled to an installed position.

According to an embodiment of the present invention, there is provided fitness equipment 400, in the form of an attachment and an upright, as shown in FIG. 9. The equipment 400 includes an upright support 401 forming part of a frame of the fitness equipment 400. An attachment 402 is linearly installed onto upright support 401. The fitness equipment 400 further includes latching pin 100 for locking the attachment onto the upright support 401. Advantageously, the latching pin 100 can lock the attachment onto the upright support 401 without direct user manipulation of latching pin 100.

Figure 10:
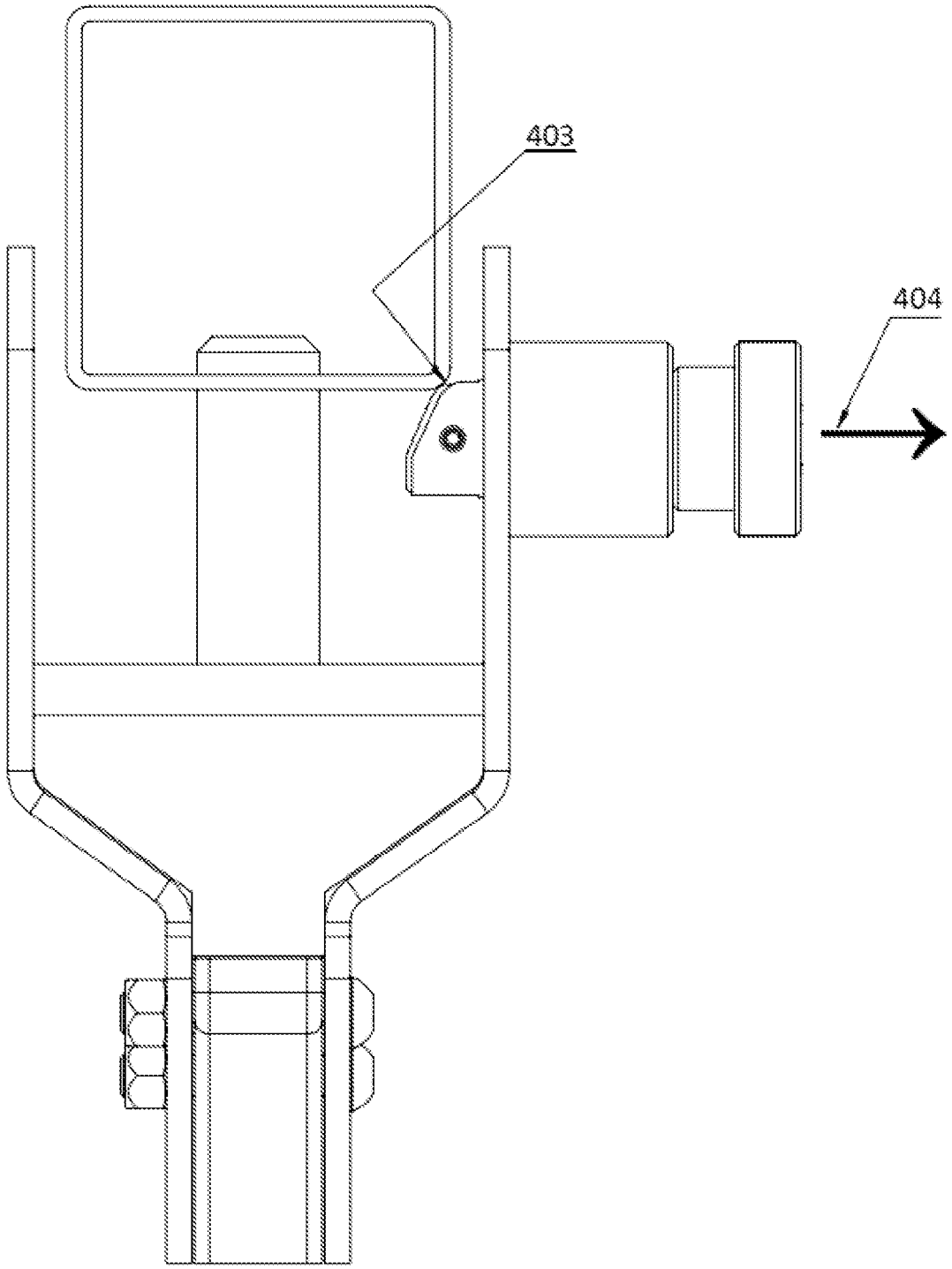
FIG. 10 is a close up partial top view of the fitness equipment of FIG. 9.
Figure 11:
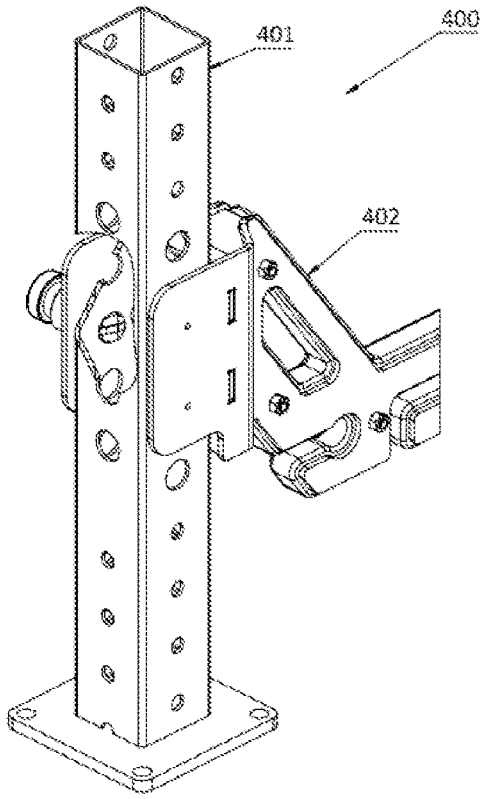
FIG. 11 is a partial perspective view of fitness equipment in FIG. 9, with the attachment in an as installed position.
Figure 12:
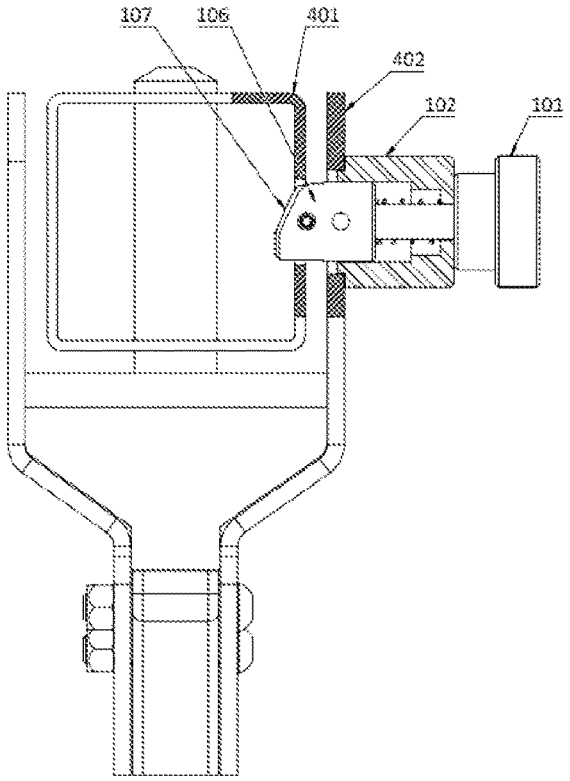
FIG. 12 is a close up partial top view of the fitness equipment of FIG. 11.

As can best be seen in FIG. 10, the latch pin 100 engages with upright support 401 at contact point 403. Latch pin 100 has a contact angle at contact point 403 such that latch pin 100 retracts in direction 404, allowing attachment 402 to be installed onto upright support 401. The foregoing installation is far less cumbersome than known pin in discrete hole arrangements.

Figure 13:
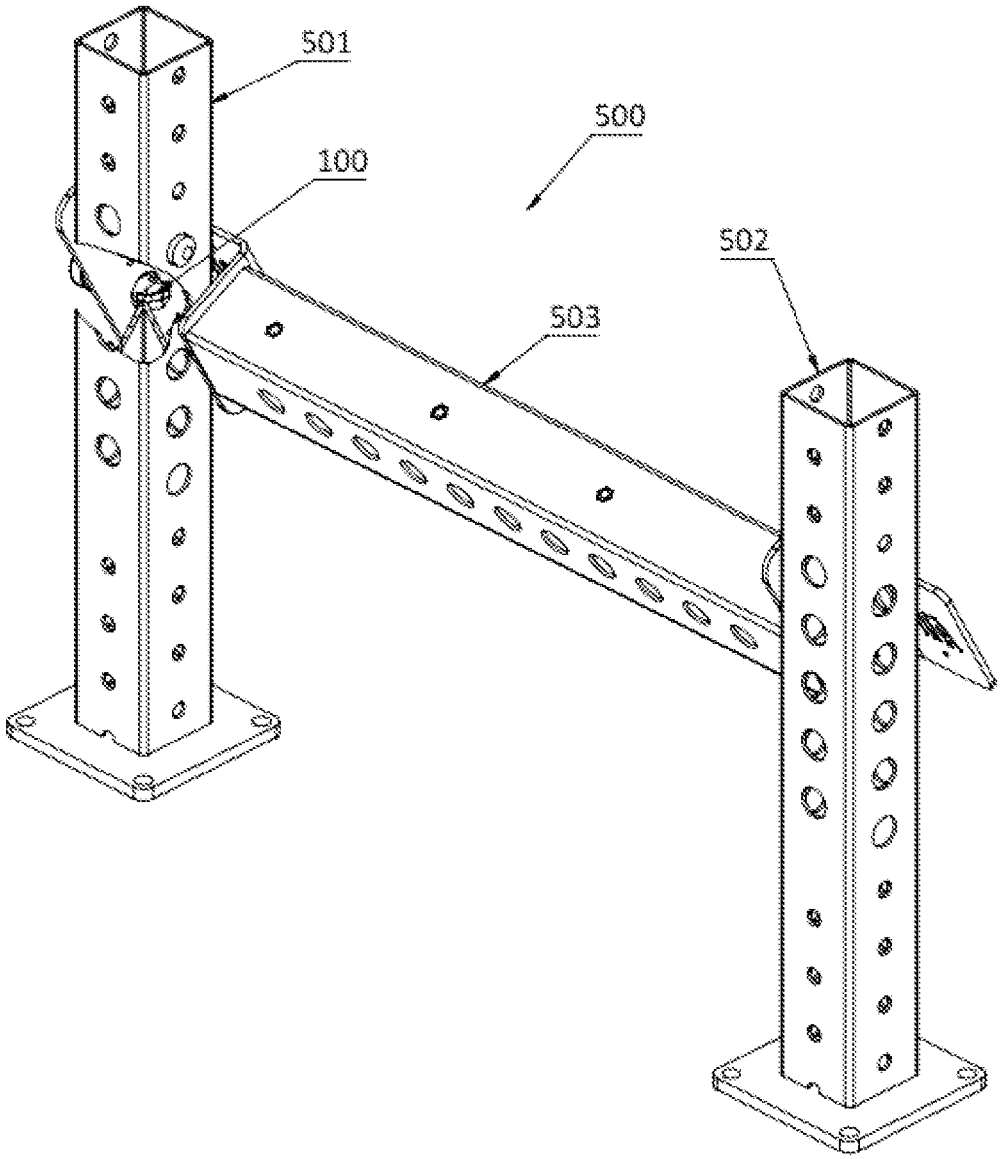
FIG. 13 is a partial perspective view of fitness equipment in accordance with another alternative embodiment of the present invention, with the attachment transitioning from an uninstalled to an installed position.
Figure 14:
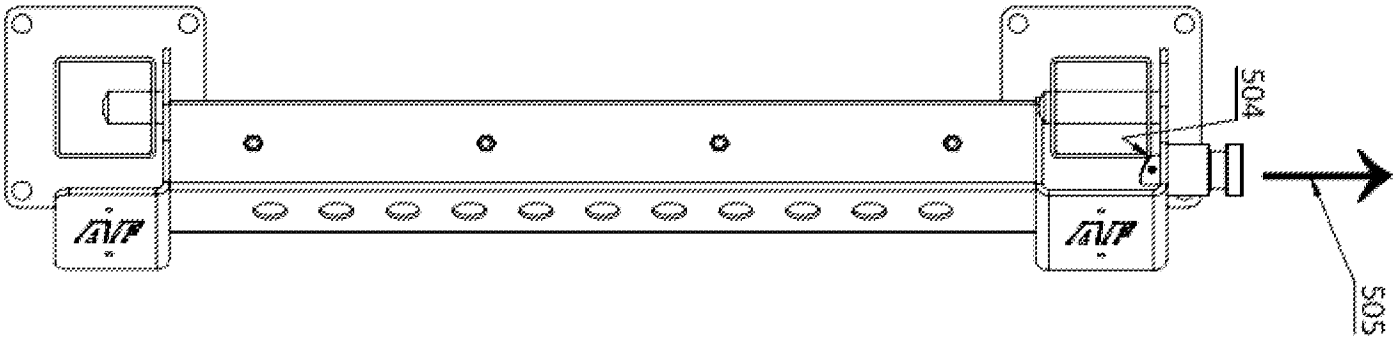
FIG. 14 is a top view of the fitness equipment of FIG. 13.

According to an embodiment of the present invention, there is provided fitness equipment 500, in the form of an attachment and uprights, as shown in FIG. 13. The equipment 500 includes upright supports 501 and 502 forming part of a frame of the fitness equipment 500. An attachment 503 is pivotally installed onto upright supports 501 and 502. The fitness equipment 500 further includes latching pin 100 for locking the attachment onto the upright support 501. Advantageously, the latching pin 100 can lock the attachment onto the upright support 501 without direct user manipulation of latching pin 100.

Figure 15:
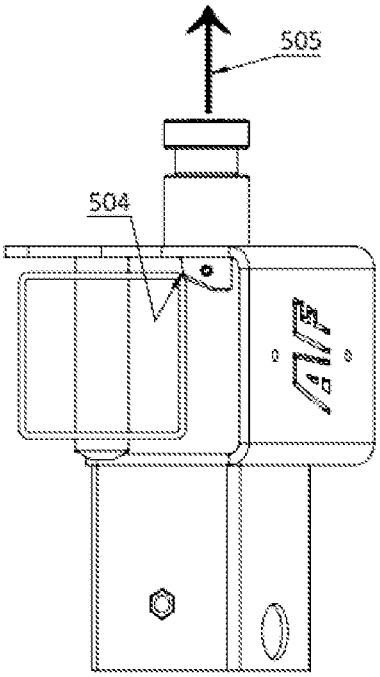
FIG. 15 is a close up partial top view of the fitness equipment of FIG. 13.
Figure 16:
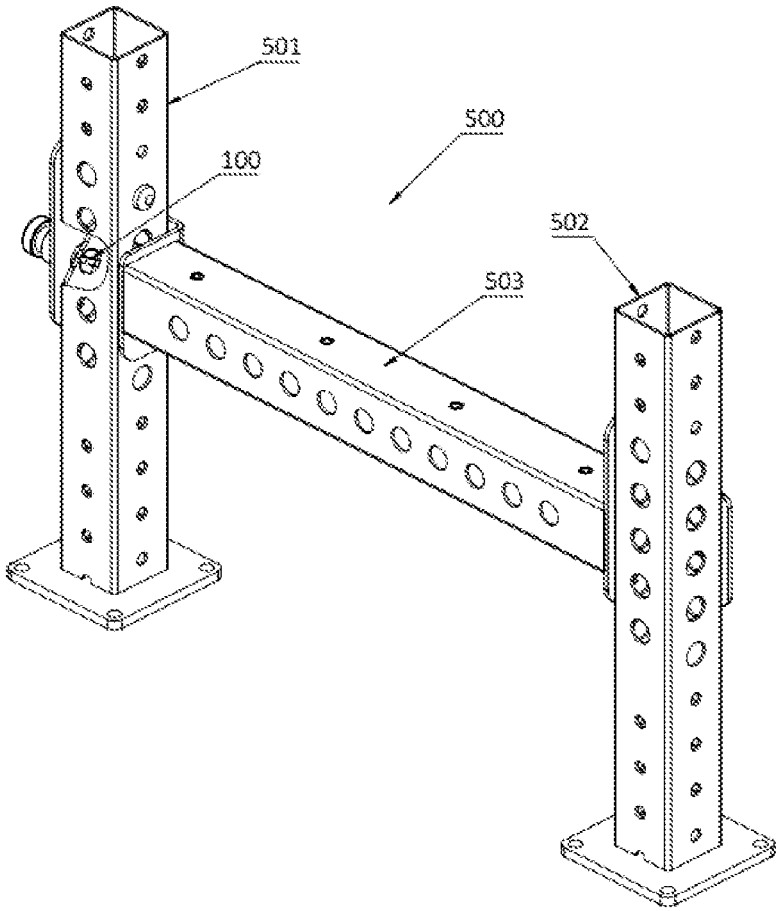
FIG. 16 is a perspective view of fitness equipment of FIG. 13, with the attachment in an installed position.
Figure 17:
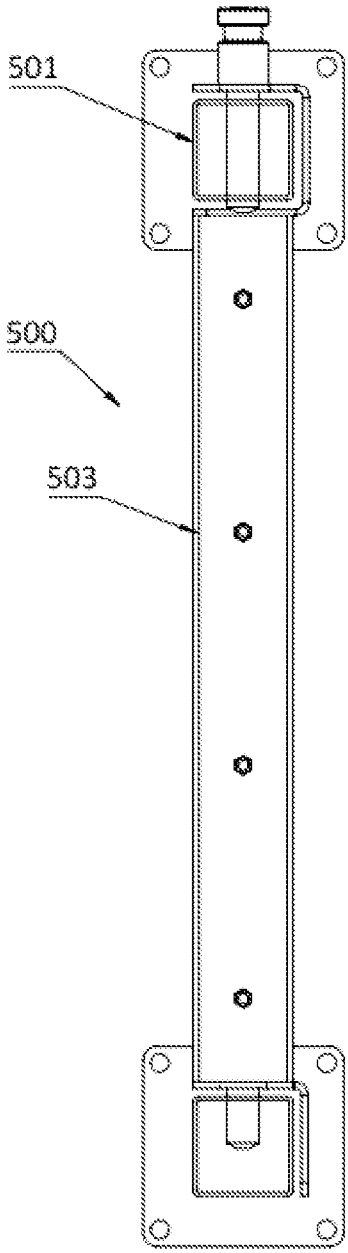
FIG. 17 is a top view of the fitness equipment of FIG. 16.
Figure 18:
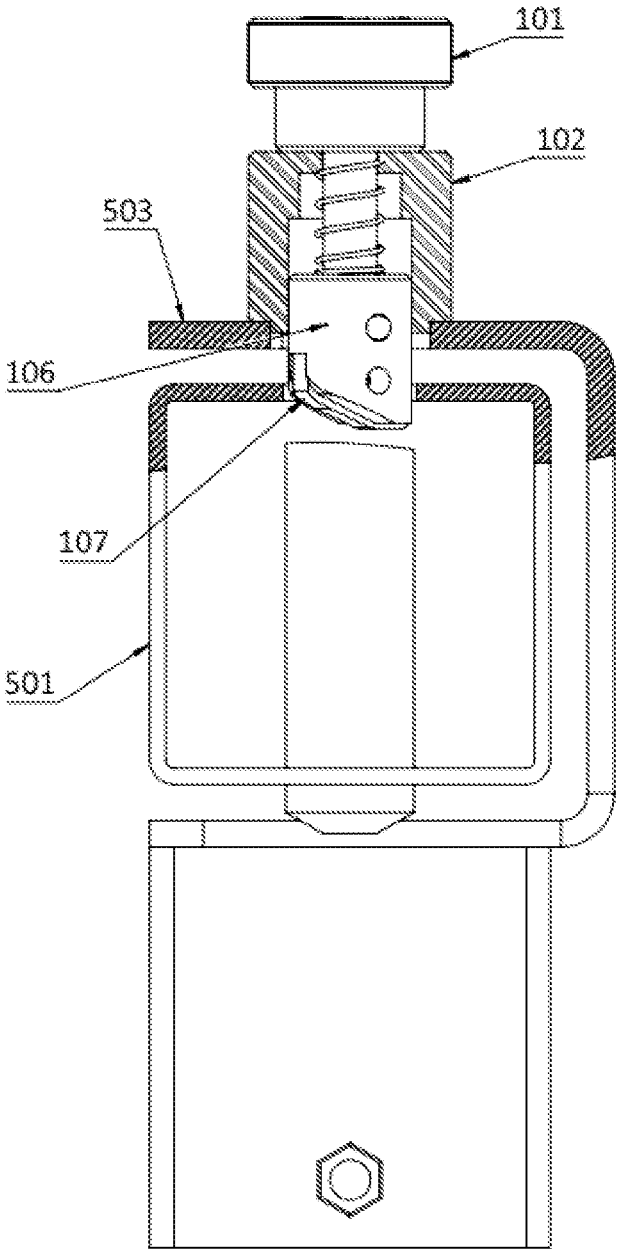
FIG. 18 is a close up partial top view of the fitness equipment of FIG. 16.

As can best be seen in FIG. 15, the latch pin 100 engages with upright support 501 at contact point 504. Latch pin 100 has a contact angle at contact point 504 such that latch pin 100 retracts in direction 505, allowing attachment 503 to be installed onto upright support 501. The foregoing installation is far less cumbersome than known pin in discrete hole arrangements.

A method for using the fitness equipment 300 is now briefly described.

Figure 5:
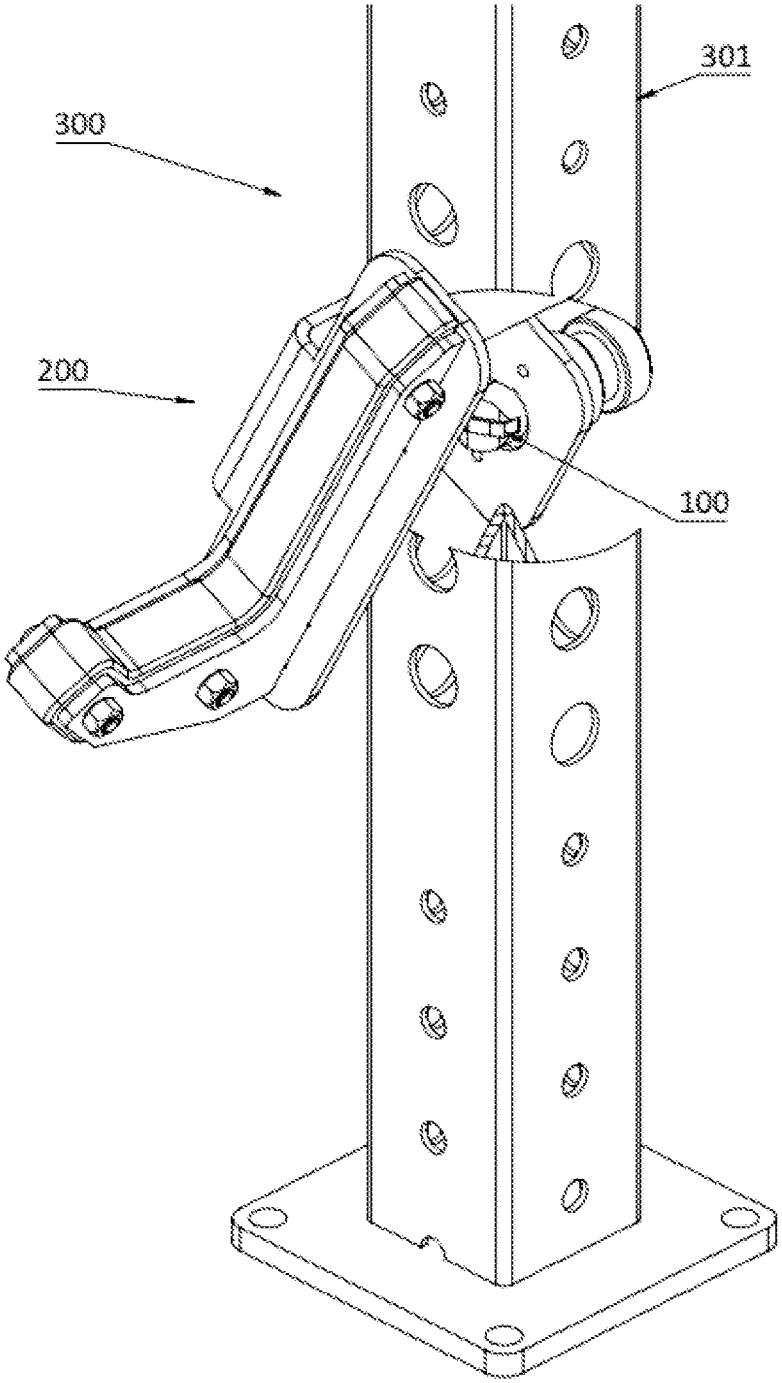
FIG. 5 is a partial perspective view of fitness equipment in accordance with an embodiment of the present invention, with the attachment transitioning from an uninstalled to an installed position.

Initially, the attachment 200 is partially installed on upright support 301 as shown in FIG. 5 with fixed pin 204 extending between a pair of aligned holes of upright support 301.

Figure 6:
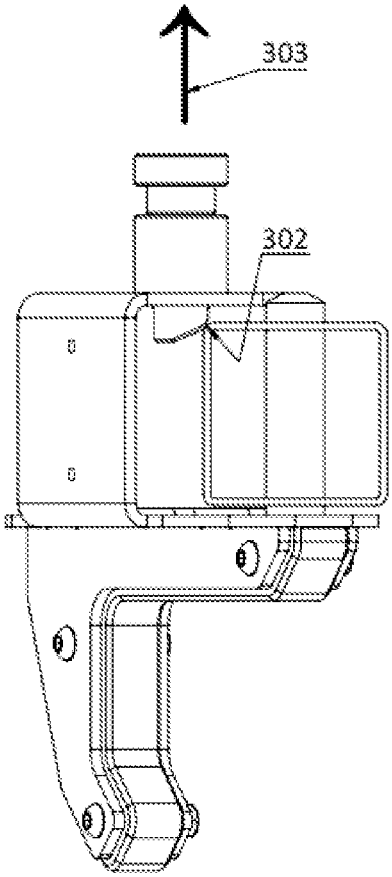
FIG. 6 is a partial top view of the fitness equipment of FIG. 5.

The exerciser moves attachment 200 to align with upright support 301 as shown in FIG. 3. Latching pin 100 retracts as shown in FIG. 6.

Once attachment 200 is aligned with upright support 301, latch pin 100 locks attachment 200 to upright support 301 as shown in FIG. 3.

Once the exerciser has completed the exercise with the attachment, knob 101 is pulled to retract latch pin 100. The attachment 200 is then rotated as shown in FIG. 5. The attachment 200 can then be removed.

A person skilled in the art will appreciate that many embodiments and variations can be made without departing from the ambit of the present invention.

In the preferred embodiment, the latch pin 100 was biased to automatically retract during installation of attachment 200 onto upright support 301. In another embodiment, the latch pin 100 is biased to automatically retract during removal of attachment 200 from upright support 301.

In the preferred embodiment, the attachment 200 was rotated to facilitate latching of latching pin 100 onto upright support 301. In another embodiment, the attachment 200 is linearly translated to facilitate latching of latching pin 100 onto upright support 301 as shown in FIG. 9.

In compliance with the statute, the invention has been described in language more or less specific to structural or methodical features. It is to be understood that the invention is not limited to specific features shown or described since the means herein described comprises preferred forms of putting the invention into effect.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

What is claimed is:

1. A fitness equipment, comprising:

an attachment;

a support including discrete formations; and a latching pin for latching with the discrete formations to fasten the attachment to the support at different locations, wherein the latching pin defines a body including a recess, said recess adapted to removably receive a replaceable, sacrificial component, wherein said replaceable, sacrificial component is configured to be at least partially received within one of said discrete formations when said attachment is fastened to said support.

2. The fitness equipment as claimed in claim 1, wherein the discrete formations are holes, and the latching pin can automatically latch within one of the holes responsive to movement of the attachment without a need for a user to handle the latching pin.

3. The fitness equipment as claimed in claim 2, wherein said movement of the attachment is pivoting by the user or linearly translating by the user.

4. The fitness equipment as claimed in claim 3, wherein the attachment includes a locator for locating the attachment along the support prior to the pivoting or the linearly translating.

5. The fitness equipment as claimed in claim 4, wherein the locator includes a pin for extending through one or more of the holes.

6. The fitness equipment as claimed in claim 2, wherein the latching pin includes a free end that is tapered to facilitate its passing around the support and into the holes for latching.

7. The fitness equipment as claimed in claim 1, wherein the latching pin includes a biasing element configured to bias the latching pin into a latched position when the attachment is fastened to the support.

8. The fitness equipment as claimed in claim 1, wherein the attachment includes a bracket or attachment plate, to which the latching pin is mounted.

9. The fitness equipment as claimed in claim 8, wherein the bracket or attachment plate, receives the support when the attachment is fastened to the support.

10. The fitness equipment as claimed in claim 1, wherein the attachment is aligned with the support when the attachment is fastened to the support.

11. The fitness equipment as claimed in claim 1, wherein the latching pin includes a knob to facilitate unfastening of the attachment from the support by pulling.

12. The fitness equipment as claimed in claim 1, further comprising a rotation inhibitor on the latching pin.

13. The fitness equipment as claimed in claim 1, wherein the replaceable, sacrificial component comprises an integral fin, said integral fin disposed at a tip of the latching pin.

14. The fitness equipment as claimed in claim 13, wherein the body of the latching pin engages with one of the discrete formations when the attachment is fastened to the support.

15. The fitness equipment as claimed in claim 13, wherein the integral fin includes an anti-scratch coating.

16. The fitness equipment as claimed in claim 1, wherein the latching pin includes a fixed mount for being fastened to the attachment, and in which a biasing means is located.

17. The fitness equipment as claimed in claim 16, wherein the fixed mount is received within the attachment.

18. The fitness equipment as claimed in claim 1, wherein the latching pin includes an anti-scratch coating.

19. The fitness equipment as claimed in claim 1, wherein the latching pin includes an integral rolling element.

20. The fitness equipment as claimed in claim 1, wherein the latching pin includes an anti-scratch cover.

* * * * *